US005508926A

United States Patent [19]

Wade

[11] Patent Number: 5,508,926

[45] Date of Patent: Apr. 16, 1996

[54] EXHAUST GAS RECIRCULATION DIAGNOSTIC

[75] Inventor: David R. Wade, Waterford, Mich.

[73] Assignee: General Motors Corporation, Detroit, Mich.

[21] Appl. No.: 265,092

[22] Filed: Jun. 24, 1994

[51] Int. Cl.[6] ..... F02D 43/00; F02M 25/06

[52] U.S. Cl. ..... 364/431.06; 123/571

[58] Field of Search ..... 364/431.06; 123/117 A, 123/119 A, 124 R, 478, 571, 339; 73/700

[56] References Cited

U.S. PATENT DOCUMENTS

| | | | |
|---|---|---|---|
| 3,977,373 | 8/1976 | Sand | 123/117 A |
| 4,114,575 | 9/1978 | Nohira et al. | 123/119 A |
| 4,114,576 | 9/1978 | Goto et al. | 123/119 A |
| 4,125,100 | 11/1978 | Assenheimer et al. | 123/124 R |
| 4,165,650 | 8/1979 | Weissler, II | 73/700 |
| 4,173,205 | 11/1979 | Toelle . | |
| 4,269,156 | 5/1981 | Drellishak | 123/478 |
| 4,373,497 | 2/1983 | Hamren . | |
| 4,383,441 | 5/1983 | Willis et al. . | |
| 4,473,056 | 9/1984 | Ishida et al. | 123/571 |
| 4,513,713 | 4/1985 | Koumura et al. | 123/339 |
| 4,671,107 | 6/1987 | Chiesa et al. . | |
| 4,719,893 | 1/1988 | Buslepp et al. . | |
| 5,014,203 | 5/1991 | Miyazaki et al. | 364/431.06 |
| 5,257,610 | 11/1993 | Ohuchi | 123/571 |
| 5,341,300 | 8/1994 | Fujimoto | 364/431.06 |

*Primary Examiner*—Kevin J. Teska
*Assistant Examiner*—Russell W. Frejd
*Attorney, Agent, or Firm*—Michael J. Bridges

[57] ABSTRACT

Restrictions in a path of flow of recirculated internal combustion engine exhaust gas from an engine exhaust system to an engine intake manifold are diagnosed when the engine is determined to be in a steady state operating condition through a monitoring of the air pressure in the engine intake manifold while the flow of exhaust gas thereto is varied according to a predetermined flow schedule. Changes in the monitored air pressure are determined over a test period, are filtered through a lag filter process having a dynamic filter coefficient, and are compared to a dynamic threshold to determine a presence of a restriction. The filter coefficient and the threshold may be adjusted in accord with the outcome of the diagnostic.

9 Claims, 8 Drawing Sheets

EXHAUST GAS RECIRCULATION DIAGNOSTIC

FIELD OF THE INVENTION

This invention relates to automotive vehicle diagnostics and, more particularly, to diagnosing faults in an automotive engine exhaust gas recirculation system.

BACKGROUND OF THE INVENTION

It is known to recirculate a portion of internal combustion engine exhaust gas to the engine fresh air intake to contribute to a reduction in the undesirable engine emission element of oxides of nitrogen NOx. Generally, exhaust gas recirculation EGR reduces the availability of oxygen during combustion in the engine, which is needed for NOx production, and increases the capacity of the engine intake air charge to absorb heat, holding combustion temperature down to levels inhibiting NOx production. The capacity of conventional internal combustion engine emission control strategies to inhibit emission of NOx corresponds on the integrity of the EGR system. The harsh environment in which the EGR system necessarily must operate, characterized by high temperatures and high levels of contaminants, contributes to a significant potential for EGR system faults, the more severe of which include restriction of EGR passageways to the engine fresh air intake. Such restriction impedes the efficiency of the EGR system in recirculating the exhaust gas to the engine fresh air intake, leading to increased emission of undesirable NOx.

Accordingly, it would be beneficial to provide for diagnosis of EGR system faults, such as may result in restriction in EGR passageways, so that timely repair or replacement may be made, for effective engine emissions reduction. To avoid unnecessary repair or replacement, a high degree of confidence should be associated with any fault that is diagnosed. The cost of the diagnostic, including any associated hardware and software, should be minimized.

SUMMARY OF THE INVENTION

The present invention provides the desirable benefit through a reliable diagnostic for EGR systems that adds no additional hardware over that provided on typical automotive vehicles, and has very little associated cost.

Specifically, a diagnostic is activated under a stable engine operating condition well-suited to testing the impact of changes in EGR quantity on engine parameters. When a very specific set of test conditions are met over a period of time, a valve already available with typical conventional EGR systems is exercised in a controlled manner through a significant range of its motion, and the impact of the EGR valve motion on engine intake air pressure is monitored. After a predetermined valve motion trajectory is complete, a maximum change in engine fintake air pressure over the entire trajectory is determined and filtered for comparison with a pressure change threshold value. A fault is indicated if the threshold is exceeded.

In a further aspect of this invention, fault threshold hysteresis is provided through a variation of the pressure change threshold in response to the determined EGR system integrity, so as to more accurately reflect faults and recovery therefrom. In yet a further aspect of this invention, two engine operating modes are identified as well-suited for EGR system diagnosis, including a cruise mode characterized by a positionally stable engine intake air valve, and a deceleration mode characterized by a closed engine intake air valve. Independent EGR system diagnostics are provided for each of these modes.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
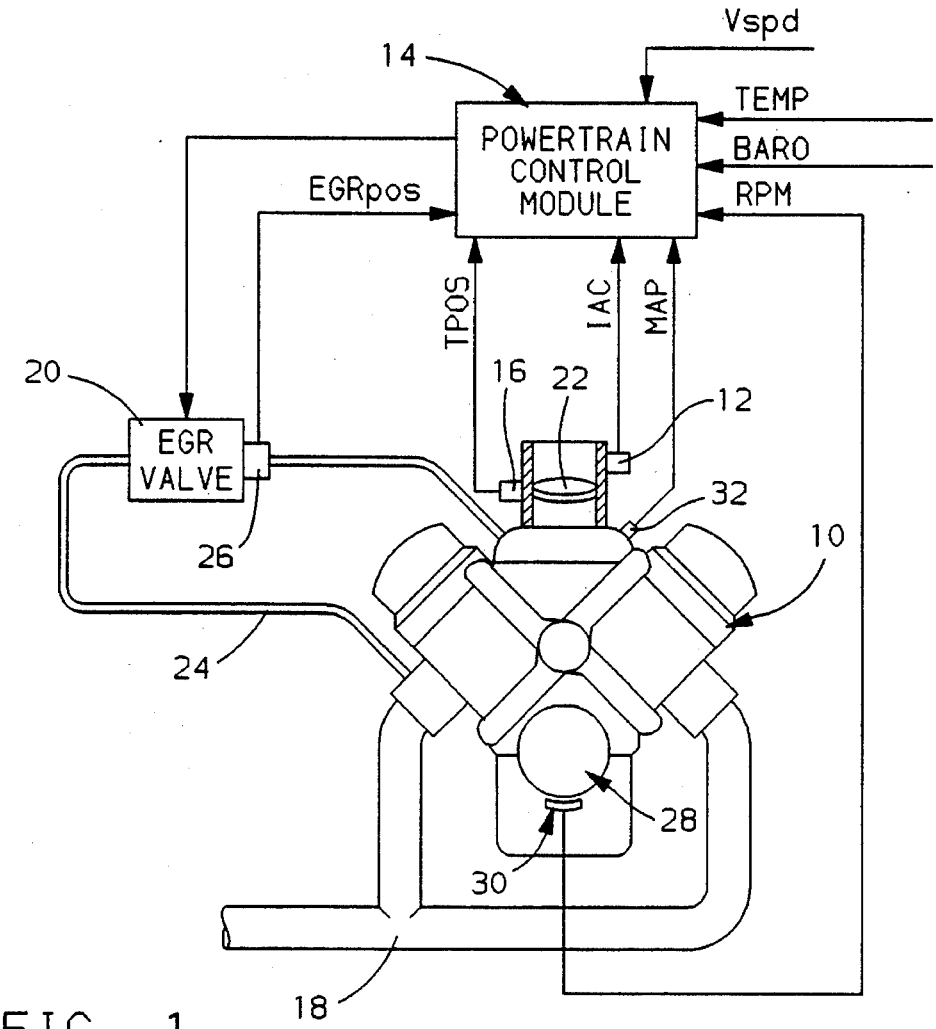
FIG. 1 is a general diagram of the engine hardware and controller in which this invention is carried out in accord with the preferred embodiment.

Referring to FIG. 1, an internal combustion engine 10 receives inlet air past inlet air valve 22, such as a conventional butterfly valve, the position of which is sensed by rotational potentiometric position sensor 16 having output signal TPOS. Inlet air passes to an engine intake manifold (not shown), the air pressure in which is sensed by conventional pressure transducer 32 and communicated as output signal MAP. Exhaust gas produced through operation of engine 10 passes to exhaust gas conduit 18 for exhaust gas treatment. Conduit 24 is open to exhaust gas conduit 18 for a recirculating a portion of the engine exhaust gas to the intake manifold. EGR valve 20, such as a conventional solenoid valve is placed in conduit 24 to selectively meter recirculated engine exhaust gas to the intake manifold. The position of the EGR valve 20 is detected by conventional potentiometric position sensor 26 having output signal EGRpos. The rate of rotation of an engine output shaft 28 is detected by a sensor 30, such as a conventional Hall effect or variable reluctance sensor, the output of which is communicated as engine speed RPM. A conventional powertrain control module PCM 14, such as an eight-bit single-chip microcontroller receives input signals from various sensors such as from the described manifold pressure, throttle position, EGR position and engine speed sensors. Additionally, inputs from conventional sensors including an engine coolant temperature sensor (not shown), a barometric pressure sensor (not shown), a vehicle speed sensor, not shown, and an idle air control valve sensor 12 having output signal IAC are provided to the PCM 14. The PCM 14 executes a series of procedures, such as stored in its conventional read only memory, whereby the input signal values are sensed and a series of actuator commands are generated to carry out conventional powertrain control, diagnostic, and maintenance operations, as is generally understood in the art.

Figure 2:
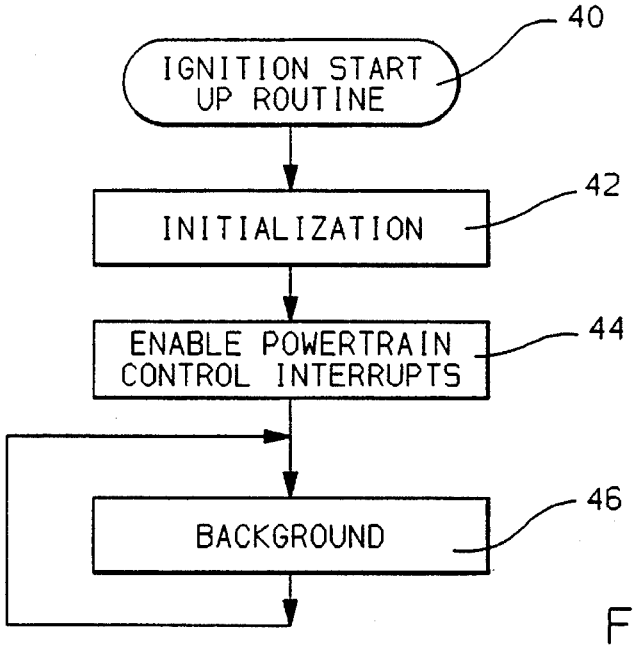
FIGS. 2–7, 8*a* and 8*b* are computer flow diagrams illustrating steps used to carry out the principles of this invention in accord with the preferred embodiment and with the hardware of FIG. 1.

These procedures may be stored as a series of steps making up software routines periodically executed while the PCM 14 is operating. To initiate such routines, following start-up of the PCM 14, such as when a vehicle operator rotates an ignition key to its "on" position, the routine of FIG. 2 is initiated starting at a step 40 and moving to a step 42 to provide for general system initialization. The initialization may include transferring constants from read only memory locations to random access memory locations, and initializing pointers, counters and flags to provide for conventional controller operations. After the initialization step, the routine of FIG. 2 proceeds to a step 44 to enable powertrain control interrupts, such as time-based and event-based interrupts used to control powertrain operations.

Included in the interrupts enabled at the step 44 is a time-based interrupt set up to occur to approximately every 100 milliseconds while the PCM 14 is operating. This time-based interrupt is enabled at the step 44 to vector controller operations to those illustrated in the routine of FIG. 3, to be described. After enabling powertrain control interrupts at the step 44, the routine of FIG. 2 proceeds to background operations at a step 46, which may include diagnostic and maintenance operations which are continuously repeated while the PCM 14 is operating. The background operations are of relatively low priority in the PCM hierarchy of operations, such that upon occurrence of any of the interrupts enable at the step 44, the background operations will temporarily cease, and the PCM will vector control to a service routine corresponding to the interrupt that occurred. Upon completion of the interrupt service routine, the background operations will resume, such as at the point they were interrupted.

Figure 3:
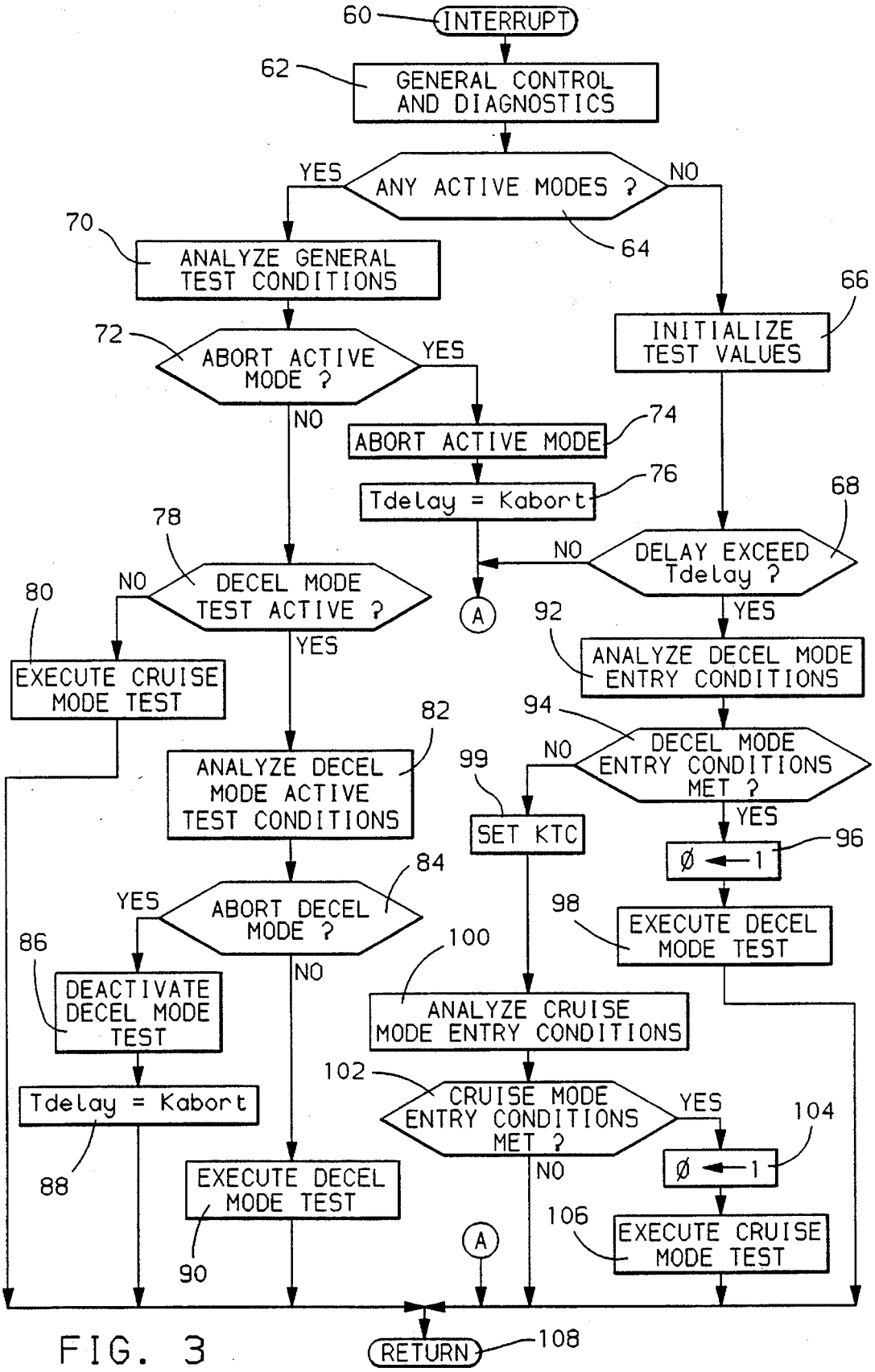

Referring to FIG. 3, an interrupt service routine is illustrated. This routine services the time-based interrupt set up, as described for the step 44 of FIG. 2, to occur approximately every 100 milliseconds while the PCM 14 is operating. Upon occurrence of the time-based interrupt, the routine of FIG. 3 will be executed starting at a step 60. The routine proceeds to a step 62 at which general powertrain control and diagnostics operations may be carried out. For example, certain of the powertrain control operations and diagnostic operations may be preferably carried out every 100 milliseconds while the powertrain control module 14 is operating. In such case, these control and diagnostic operations may be carried out at the step 62.

After completing any such control and diagnostic operations, the routine of FIG. 3 proceeds to a step 64 to determine if any diagnostic modes are active. Diagnostic modes, in this embodiment, include a cruise mode and a deceleration (decel) mode, in each of which an EGR system diagnostic is carried out, as will be described in further detail. If either of these modes are active as determined at the step 64, the routine proceeds to a step 70 to analyze general test conditions, through the routine of FIG. 4, to be described. These general test conditions must be present for the active mode to continue on in this embodiment.

After the step 70, the routine proceeds to a step 72 to determine if any of the general test conditions were determined to not be present via the step 70, in which case the active mode should be aborted. If it is determined that the active mode should be aborted at the step 72, the routine proceeds to a step 74 to abort the active mode such as by discontinuing any operations for that mode. The routine then proceeds to step 76 to set a time delay value Tdelay to a predetermined value Kabort, which is set to approximately 500 milliseconds in this embodiment. The routine then proceeds to a step 108 to be described.

Returning to the step 72, if the active mode need not be aborted, the routine proceeds to a step 78 to determine if the deceleration mode test is currently active. If it is currently active the routine proceeds to a step 82 to analyze deceleration mode active test conditions, which include conditions necessary for the deceleration active test mode to continue once it has begun. In this embodiment, such active test conditions include a determination of whether the change in engine speed RPM exceeds a maximum value of approximately 100 RPM over a predetermined test interval, such as over a 100 millisecond test interval.

If engine speed RPM has increased by over 100 RPM during the most recent 100 milliseconds as determined at the step 82, then the deceleration mode should be aborted, and the routine proceeds from the step 84 to a step 86 to deactivate the deceleration mode test that is currently operating, such as by discontinuing any deceleration mode test operations, and then proceeds to a step 88 to set Tdelay to Kabort, as described. The routine then proceeds to the step 108, to be described.

Figure 6:
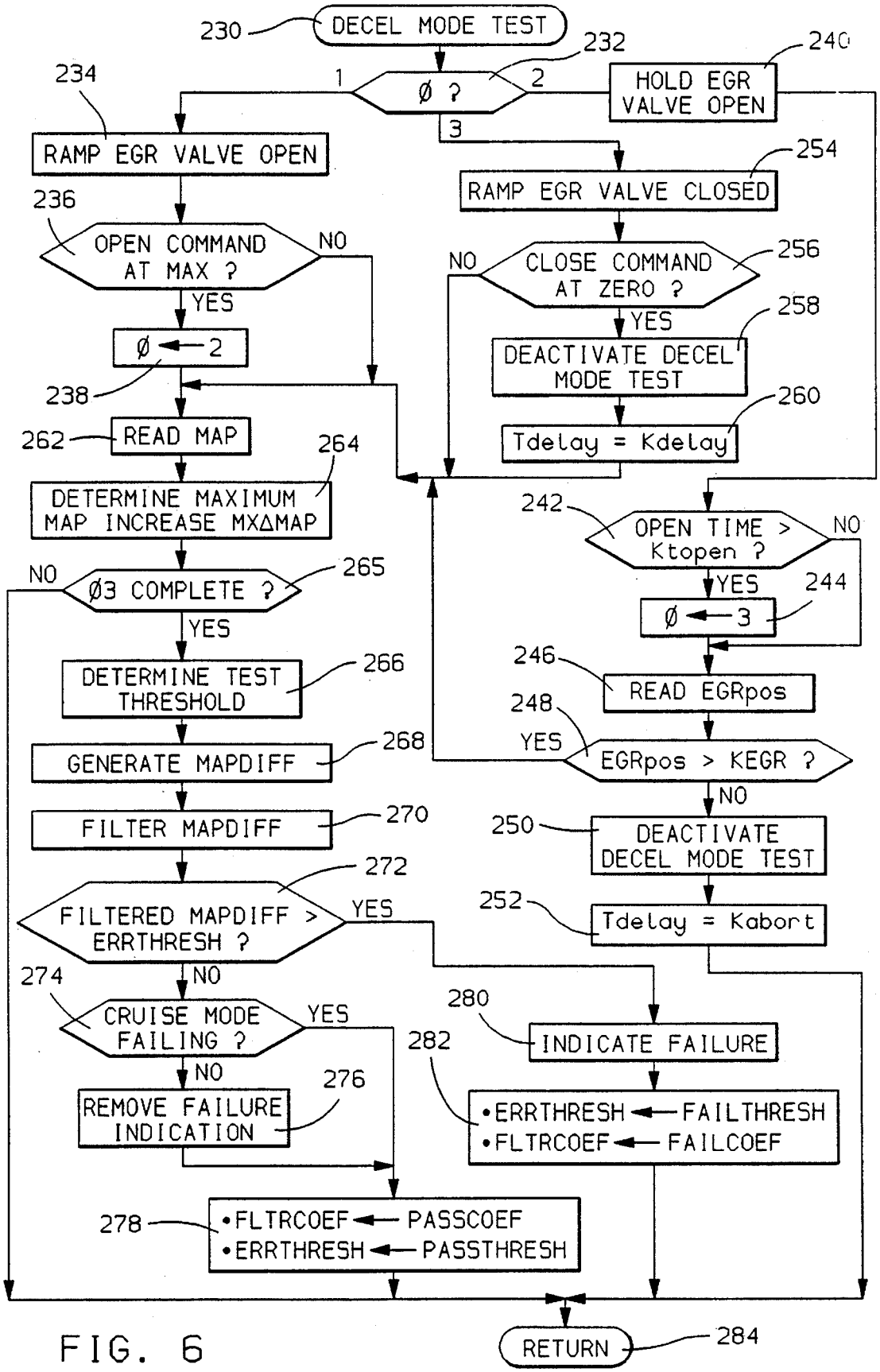

Returning to the step 84, if the deceleration mode is not to be aborted as the engine speed has not changed by more than 100 RPM during the last 100 milliseconds, the routine proceeds to a step 90 to execute the deceleration mode test, by carrying out the routine of FIG. 6, to be described. The routine of FIG. 3 then proceeds to the step 108 to be described. Returning to step 78, if the deceleration mode test is not currently active, the routine proceeds to the step 80 to execute the cruise mode test, by executing the routine described in FIGS. 8*a* and 8*b*, to be described. The routine of FIG. 3 then proceeds to the step 108.

Returning to the step 64 of the routine of FIG. 3, if neither of the modes of the present embodiment are active, the routine proceeds to a step 66 to initialize test values to prepare for either of the test modes of the EGR system diagnostic of this embodiment. The initializing of the test values may include resetting any pointers, counters or data variables that are stored during the carrying out of either of the tests. After the step 66 the routine proceeds to a step 68 to determine if a time delay between tests has exceeded the value Tdelay. The time delay between tests, whether the tests were completed or aborted, must exceed the stored value Tdelay in this embodiment to allow for meaningful analysis in each of the tests, and in the case of an aborted test, to allow the condition which led to the aborted test to stabilize before testing is resumed. If the delay between tests, which may be a stored time value, does not exceed Tdelay at the step 68, the routine proceeds to the step 108. However, if the delay does exceed Tdelay at the step 68, the routine proceeds to determine if either of the two test modes should be activated. Specifically, the routine proceeds to a step 92 to analyze conditions needed for entry into the deceleration test mode of this embodiment. This analysis is carried out by vectoring to a routine of FIG. 5, to be described. After analyzing the entry conditions for the deceleration mode at the step 92, the routine proceeds to a step 94 to determine if those conditions were met. If so, the routine proceeds to a step 96 to set a phase value to one, indicating a start of the deceleration mode test, and then proceeds to a step 98 to execute the deceleration mode test, by vectoring to the routine of FIG. 6, as described. After completion of the deceleration mode test the routine of FIG. 3 proceeds to the step 108.

Alternatively at the step 94, if the deceleration mode entry conditions were not met, the routine proceeds to a step 99 to set a value KTC to about one second, for use in cruise mode entry conditions analysis. The routine then moves to a step 100 to analyze the conditions precedent to entry into the cruise mode test of this embodiment. This analysis is carried out through the steps of the routine of FIG. 7, to be described. After analyzing the cruise mode entry conditions at the step 100, the routine proceeds to a step 102 to determine if those conditions were met. If so, the routine proceeds to a step 104 to set a phase value $\phi$ to one to indicate the beginning of the cruise mode test, and then proceeds to step 106 to execute the cruise mode test, such as by vectoring control to the routine of FIGS. 8*a* and 8*b*, to be described. Returning to the step 102, if the cruise mode entry conditions were not met as analyzed at the step 100, or after executing the cruise mode test at the step 106, the routine advances to the step 108 where it is directed to return to the background operations illustrated at step 46 of FIG. 2.

Figure 4:
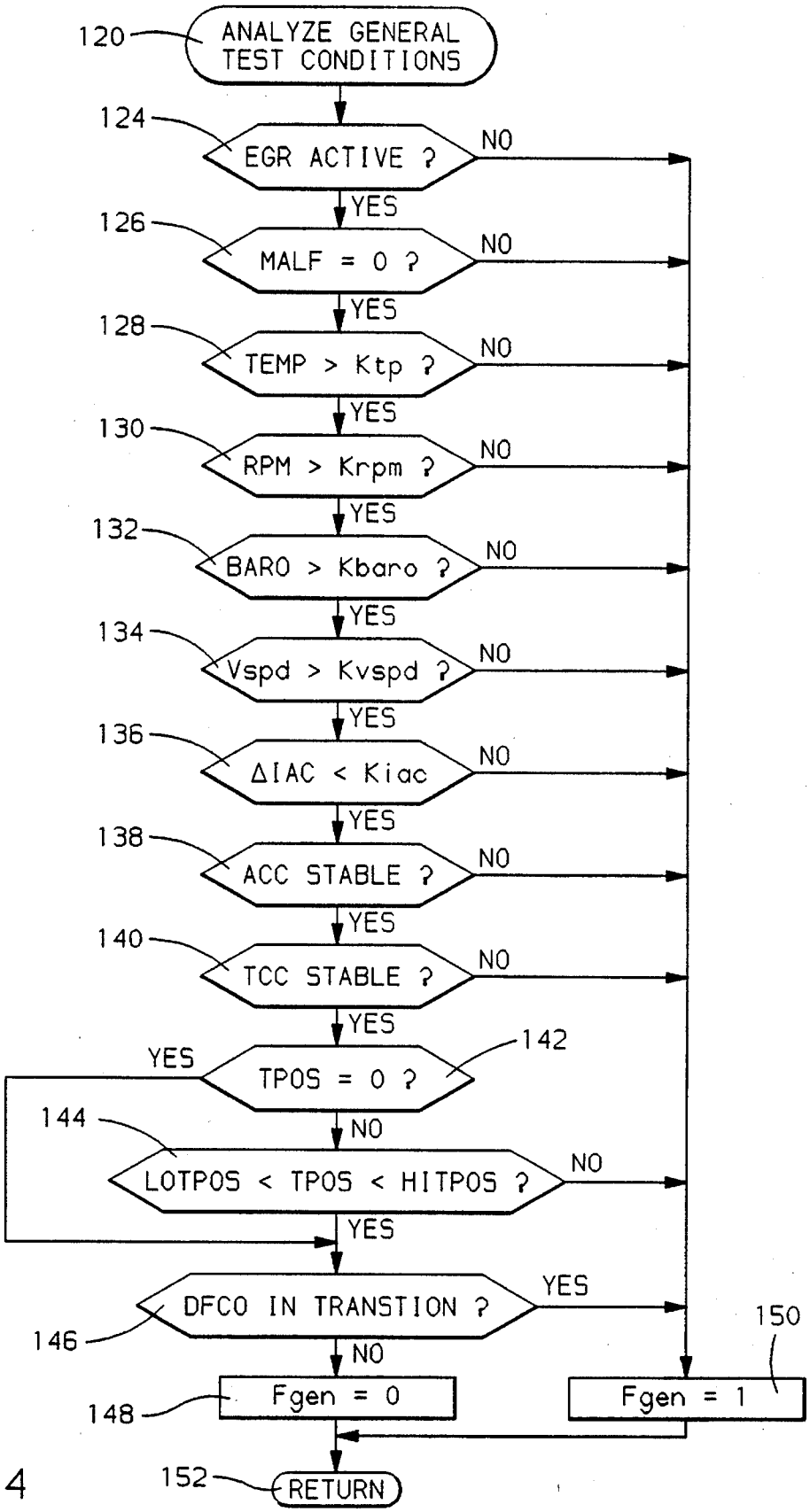

The routine of FIG. 4 illustrates general test condition analysis in accord with this embodiment in which a series of test conditions are analyzed to determine if the engine is operating in a sufficiently stable state to allow for a reliable diagnosis of the EGR system, in accord with this invention. This lengthy set of conditions is intended to indicate whether the engine is operating in a stable state in which strong correlation between changes in exhaust gas recirculation quantity and changes in manifold pressure in the engine intake manifold can be drawn. This series of test conditions is not necessarily consistent with all applications of this invention but is merely the set of test conditions sufficient to determine the stability and correspondence needed to carry out this diagnostic in accord with the preferred embodiment of this invention. Additional test conditions may be needed in alternative embodiments within the scope of this invention or certain of the test conditions of FIG. 4 may be determined to be unnecessary in such alternative embodiments.

Specifically, the routine of FIG. 4 is entered at a step 120 and proceeds to a step 124. Summarizing the test conditions of FIG. 4, the exhaust gas recirculation EGR must be active as determined at a step 124, there must be no malfunction codes indicating a previous presence of a failure in the system at the step 126, the engine coolant temperature TEMP must exceed a temperature threshold Ktp of approximately 80 degrees Celsius at a step 128, the engine speed RPM must exceed a threshold engine speed Krpm of approximately 800 RPM at a step 130 to indicate that the engine is not in a stall condition, the barometric pressure BARO must exceed the pressure constant Kbaro of approximately 60 kPa at a step 132, the speed of the vehicle Vspd must exceed a value Kvspd of approximately 20 miles per hour at a step 134, the change in idle air control valve position ΔIAC over a predetermined time interval such as about 100 milliseconds must be less than a constant value Kiac to indicate a positionally stable idle air control valve so as to not disturb the test of this embodiment at a step 136, the air conditioning clutch ACC must be stable to stabilize the engine load at step 138, the torque converter clutch TCC must be stable so as to avoid disturbing engine load at this embodiment at step 140, and the throttle position TPOS either must be at zero or must be positionally stable such as between a low position LOTPOS of approximately four percent throttle and a high throttle position HITPOS of approximately twenty percent throttle at the respective steps 142 and 144, and the deceleration fuel DFCO condition of the powertrain controller 14 must not be in transition at a step 146.

If all of these conditions are true, then the flag FGEN is cleared at a step 148. If any of these conditions are not true as described in the routine of FIG. 4, the flag FGEN is set to one at a step 150 indicating that at least one of the test conditions is not currently present. After updating the flag FGEN through the routine of FIG. 4, the routine proceeds to a step 152 to return to the routine from which it was called.

Figure 5:
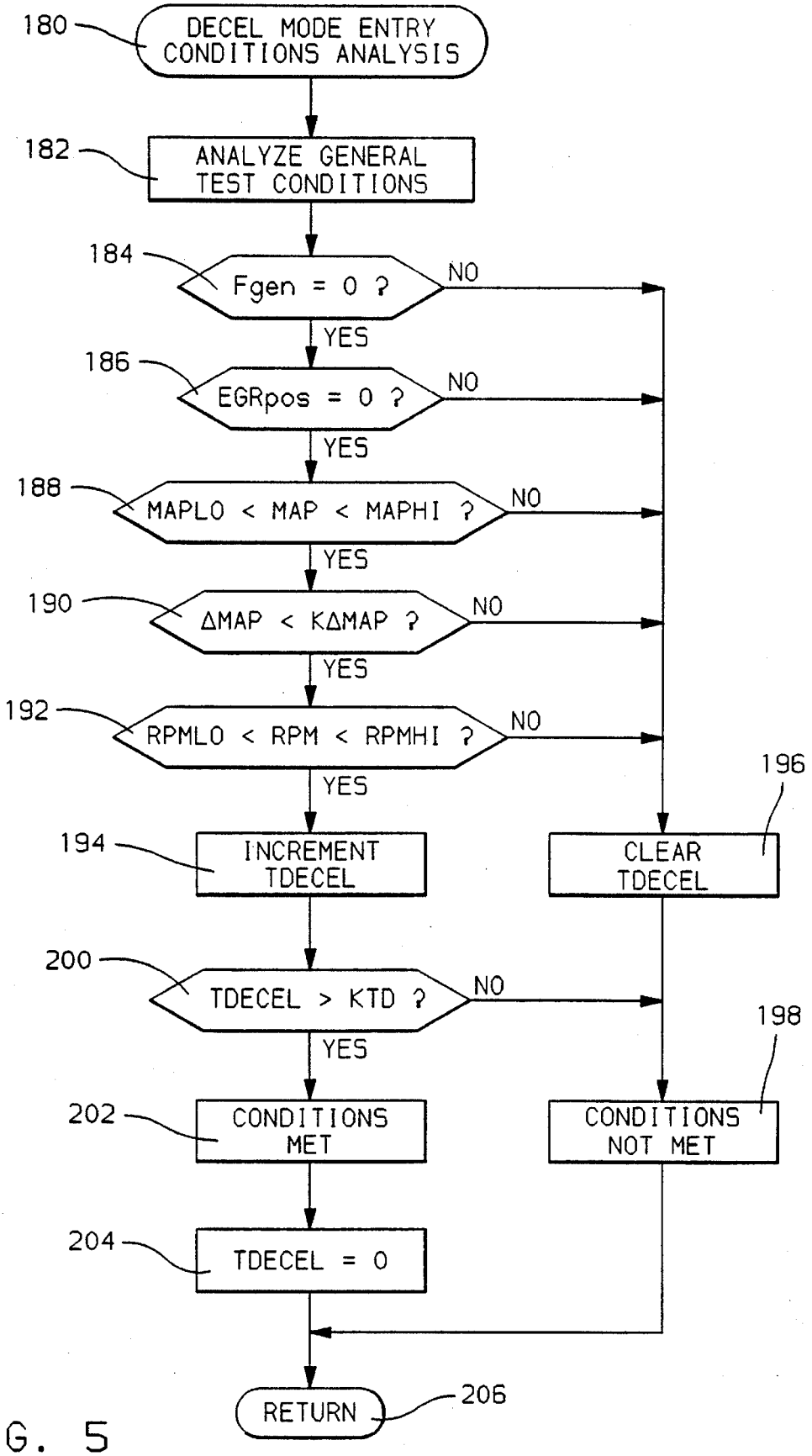

Referring to FIG. 5, the routine to analyze the deceleration test mode entry conditions is illustrated, as may be called at the step 92 of the routine of FIG. 3, as described. The analysis of the routine of FIG. 5 is specifically directed to the deceleration test mode of this embodiment to determine if specific conditions necessary for operation in the deceleration test mode are present. The routine of FIG. 5 starts at a step 180 when called at the step 92 of the routine of FIG. 3, and then proceeds to a step 182 to analyze general test conditions, by calling the routine of FIG. 4, as described. The routine of FIG. 5 next proceeds to a step 184 to determine the status of the flag FGEN as updated by the routine of FIG. 4. If FGEN is clear, indicating that the general test conditions are currently present, the routine of FIG. 5 proceeds to a step 186 to determine if the EGR valve is closed.

If the EGR valve is closed as determined by reading the EGR position sensor 26 of FIG. 1, the routine of FIG. 5 proceeds to a step 188 to determine if the manifold absolute pressure MAP is within bounds including MAPLO of approximately 10 kPa and MAPHI of approximately 40 kPa. If MAP is within such bounds, the routine of FIG. 5 proceeds to a step 190 to determine if change in MAP ΔMAP is less than a constant K delta MAP of approximately one-half KPA. ΔMAP may be determined as a difference in MAP values between a minimum sensed MAP value and a maximum sensed MAP value taken over a predetermined time interval, such as about a one second time interval. If ΔMAP is less than the KΔMAP value at the step 190, indicating a stable MAP value conducive to the diagnostic of this embodiment, the routine of FIG. 5 proceeds to a step 192 to determine if engine speed RPM is within a range defined by RPMLO of approximately 1,000 RPM, and RPM high of approximately 1600 RPM.

If engine speed is within that range, the routine of FIG. 5 proceeds to increment a time count value TDECEL at a step 194 to indicate that 100 millisecond interrupt has occurred which the decel mode entry conditions were present and then proceeds to a step 200 to determine if the value TDECEL exceeds a constant value KTD of approximately five. If TDECEL exceeds KTD at the step 200, then the deceleration entry conditions have been present for at least 500 milliseconds, indicating that the entry conditions are met. In such a case, the routine of FIG. 5 proceeds to a step 202 to indicate that the conditions have been met and then resets TDECEL to zero at the step 204, after which the routine proceeds to a step 206 to return to the routine from which it was called.

Returning to the steps 184–192, if any of the entry conditions of the deceleration mode as analyzed through the routine of FIG. 5 are not met, then the routine proceeds to a step 196 to clear the value TDECEL which counts the number of iterations in which all the conditions are met at a step 196. The routine then proceeds to a step 198 to indicate that the conditions have not been met, after which the routine proceeds to a step 206 to return to the routine from which it was called. Accordingly, an indication is made through the execution of the routine of FIG. 5 as to whether entry into the deceleration test mode is appropriate.

The routine of FIG. 6 illustrates the steps used to carry out the deceleration test mode of the present embodiment in accord with the EGR system diagnostic of the present invention. The routine of FIG. 6 is executed when called at a step 98 of the routine of FIG. 3 or at a step 90 of the routine of FIG. 3 after the test conditions necessary for entry into the deceleration test mode have been met, as described. When the deceleration test mode is to be executed, the routine of FIG. 6 is called and is entered in a step 230 and proceeds to a step 232 to determine which phase $\phi$ of the test is currently active. The phases of the test indicate generally how to actuate the EGR valve in accord with an examination of the relationship between a controlled EGR valve motion and change in manifold absolute pressure, in accord with the present invention.

If phase one of the test is determined to be active at the step 232, the routine of FIG. 6 proceeds Eo a step 234 to begin a controlled ramping of the EGR valve from its starting closed position to a predetermined open position, such as about fifty percent of its fully open position. In this embodiment, 500 milliseconds is used as the time to open the valve at a substantially constant opening rate from its closed position to the predetermined open position. The rate at which the valve is open is then determined by dividing the range of desired valve motion by the opening time, such as the 500 milliseconds preferred in the present embodiment. For example, the desired range of valve motion that may be commanded may include 50 steps or counts. To open the valve at a fixed rate over 500 milliseconds, the position should then be increased by one step or count every ten milliseconds. The PCM 14 (FIG. 1) may be set up to command such an opening rate through the exercise of generally understood microprocessor control practices, or such an opening rate may be provided for in hardware, such as by setting up a digital counter (not shown) to, upon receipt of a starting command from the PCM 14, start counting from an initial value to a final value, such as from 0–50 at a predetermined rate. The counter output may be passed through a conventional digital-to-analog converter (not shown), the output of which may be applied to a driver responsive to the analog level for driving the EGR valve.

After initiating the ramping of the EGR valve from its closed position to its predetermined open position at the step 234, the routine of FIG. 6 proceeds to a step 236 to determine if the opening valve command is at a predetermined maximum value corresponding to the predetermined open value, such as fifty percent of its fully open value as described, indicating that the predetermined opening position has been reached. If at the step 236 the opening command is at such a maximum, the ramping is assumed to be complete, and the routine proceeds to a step 238 to set the phase value to two, indicating the start of phase two and the completion of the opening phase one. Next, or if the open command was not at its maximum value at the step 236, the routine proceeds to a step 262, to be described.

Returning to the step 232, if the phase value is set to two, the routine proceeds to a step 240 to hold the EGR valve at the predetermined open position, such as the fifty percent of fully open position, for the duration of the phase two, and then proceeds to a step 242 to determine if the open time, which is the time duration spent in phase two, exceeds a constant Ktopen, set to one second in this embodiment. If the open time exceeds Ktopen at the step 242, then the phase two of the current test is complete and the routine proceeds to a step 244 to set the phase value to three indicating that phase three should now be started. Next, or if the open time did not exceed Ktopen at the step 242, the routine proceeds to a step 246 to read the EGR position sensor 26 (FIG. 1) output value EGRpos and then, at a step 248 compares EGRpos to a value Kegr, which is set to a value corresponding to about 95 percent of the predetermined open position of the EGR valve.

If EGRpos exceeds Kegr at the step 248, then the actual EGR position substantially corresponds to the commanded predetermined open position for the phase two of the deceleration mode test and the routine proceeds to a step 262. If EGRpos does not exceed KEGR at the step 248, the deceleration mode diagnostic test is aborted, as it is assumed some fault is present in the EGR system which has lead to a significant difference between actual and commanded EGR valve position, and which may reduce the integrity of the present diagnostic. To abort the diagnostic, the routine proceeds to a step 250 to deactivate the deceleration mode test and then to a step 252 to set the time delay value TDELAY to the value KABORT which is set to 500 milliseconds in this embodiment to allow a 500 millisecond delay before this resumption of any further EGR diagnostics. The routine then proceeds to a step 284 at which it returns to the routine from which it was called.

Returning to the step 232, if the phase is set to three, the routine proceeds to a step 254 to begin a controlled ramping of the EGR valve from its predetermined open position to its closed position. The ramp rate or the rate at which the EGR valve is closed is determined by dividing the time in phase three, which is about 500 milliseconds in this embodiment, by the amount of motion required to fully close the valve from the predetermined open position. The approach to determining the ramp rate and of issuing EGR valve actuation commands to actuate the valve in accord with that ramp rate may be as provided at the described step 234 of FIG. 6.

After initiating the ramping of the EGR valve toward its closed position at the step 254, the routine proceeds to a step 256 to determine if the EGR closing command is at substantially zero indicating that the EGR valve has been commanded fully closed. If so, the phase three test is complete, the valve has been returned to its initial setting of zero, and the routine proceeds to a step 2S8 to deactivate the deceleration mode of the test so that no further iterations of the routine of FIG. 6 will occur until another deceleration mode test is initiated. A phase three complete flag may also be set in a memory location at this step, for use at the step 265. The routine then proceeds to a step 260 to set the time delay value Tdelay to a value Kdelay, which is set to approximately one second in this embodiment, to allow for a full second of delay between completed diagnostic tests.

After either the step 238, 236, 248, 256 or 260, the routine of FIG. 6 proceeds to steps 262–282 to analyze manifold absolute pressure MAP to be used to provide an indication of EGR system integrity. Generally, the portion of this diagnostic attempts to determine the maximum change in MAP corresponding to the actuated EGR valve during the deceleration mode test. Specifically, the routine reads the manifold absolute pressure MAP value at a step 262 as output by the MAP sensor 32 of FIG. 1, and then proceeds to a step 264 to determine the maximum MAP increase MXΔMAP during the current deceleration mode test as the difference between a reference MAP value and the maximum MAP value sensed over a predetermined time interval, such as over the current active deceleration mode test.

After determining MXΔMAP at the step 264, the routine proceeds to a step 265 to determine if the current deceleration mode test is complete, such as may be indicated by the phase 3 of the current test being complete. If the test is not complete, the routine moves to the described step 284, to exit the current iteration of the deceleration mode test. If the test is complete, the routine moves to analyze the maximum change in MAP value over the test starting at a step 266, at which a test threshold value is determined as a predetermined function of barometric pressure BARO and engine speed RPM sensed during predetermined steady state conditions and stored in memory for use at this step 266. The BARO value and the RPM value used to determine the test threshold compensate for the impact of BARO and engine speed on the relationship between manifold absolute pressure changes and EGR valve position. Accordingly, the test threshold allows for changing engine operating conditions to not affect the accuracy of the diagnostic of this embodiment. After determining the test threshold according to the predetermined relationship described at the step 266, the routine proceeds to a step 268 to generate a value MAPDIFF as a difference between the maximum MAP change MXΔMAP and the determined test threshold. The MAPDIFF value is then filtered to form FMAPDIFF at a step 270 according to the following lag filter process $$FMAPDIFF=FMAPDIFF-(FMAPDIFF-MAPDIFF)*FLTRCOEF$$

in which the lag filter coefficient FLTRCOEF is determined through the exponentially weighted moving average process as is generally understood in the art and varies according to the state of the diagnostic of this embodiment. For example, through the exponentially weighted moving average process, when the EGR system is diagnosed to be substantially fault free according to the present diagnostic, the filter coefficient for the lag filter process of step 270 is set to approximately 0.1, and under conditions under which a failure is detected through the current diagnostic, the filter coefficient is adjusted to 0.3, as will be described.

After passing MAPDIFF through the lag filter process at the step 270 to form FMAPDIFF, the routine proceeds to a step 272 to compare FMAPDIFF to an error threshold value ERRTHRESH. The value ERRTHRESH is set to a calibrated value of approximately 1 kPa when the EGR system is diagnosed to be substantially fault-free through the present diagnostic, and is set to approximately 0.5 kPa when the diagnostic indicates a failing EGR system, as will be described.

If FMAPDIFF exceeds the applicable ERRTHRESH value at the step 272, a failure is indicated at the step 280, such as by illuminating an indicator on a vehicle instrument panel (not shown), or by storing an error code in non-volatile PCM 14 memory, or both, at a step 280. The routine then proceeds to adjust ERRTHRESH to the threshold value FAILTHRESH corresponding to a diagnosed error condition, which is approximately 0.5 kPa, and the filter coefficient to the failing EGR system coefficient FAILCOEF of approximately 0.3, as described. The routine then proceeds to step 284 at which it returns to routine from which it was called.

Returning to step 272, if FMAPDIFF does not exceed ERRTHRESH, a failure is not detected for the current deceleration mode test and the test moves to a step 274 to determine if the cruise mode test of the present embodiment, as will be described, has indicated a failing EGR system. If the cruise mode has not indicated such a failure through its diagnostic process, the routine proceeds to a step 276 to remove any currently active failure indication, such as by de-activating a warning lamp on a vehicle instrument panel or by removing a failure indication from non-volatile PCM 14 (FIG. 1) memory. This deactivation is only made when both the cruise mode test and deceleration mode test agree that there is no current EGR system failure or fault such as a restriction in the EGR conduit 24 of FIG. 1 that would impede the proper recirculation of engine exhaust gas for NOx reduction, as described.

After removing the failure indication at the step 276, or if the cruise mode is determined to currently be indicating a failing EGR system at the step 274 such that the failure indication removal is not appropriate, the routine proceeds directly to a step 278 to set the filter coefficient FLTRCOEF for the lag filter applied at the step 270 to a passing coefficient PASSCOEF of approximately 0.1, and sets the error threshold value ERRTHRESH applied at the step 272 to a threshold PASSTHRESH corresponding to the passing deceleration mode test of approximately one kPa. By switching the error threshold between a failing threshold and a passing threshold at the steps 282 and 278, hysteresis is provided in the threshold to avoid oscillating between failed and passed conditions for a substantially steady filtered MAPDIFF value.

In the same way, the threshold PASSTHRESH used to determine a failure in a "healthy" EGR system (a system having no current detected faults) is a more significant pressure difference value to allow for such hysteresis, as is generally understood in the art to protect against failure indication oscillations. After making any necessary adjustments to FLTRCOEF and ERRTHRESH at the step 278, the routine proceeds to the step 284 to return to any prior routine from which it was called.

Figure 7:
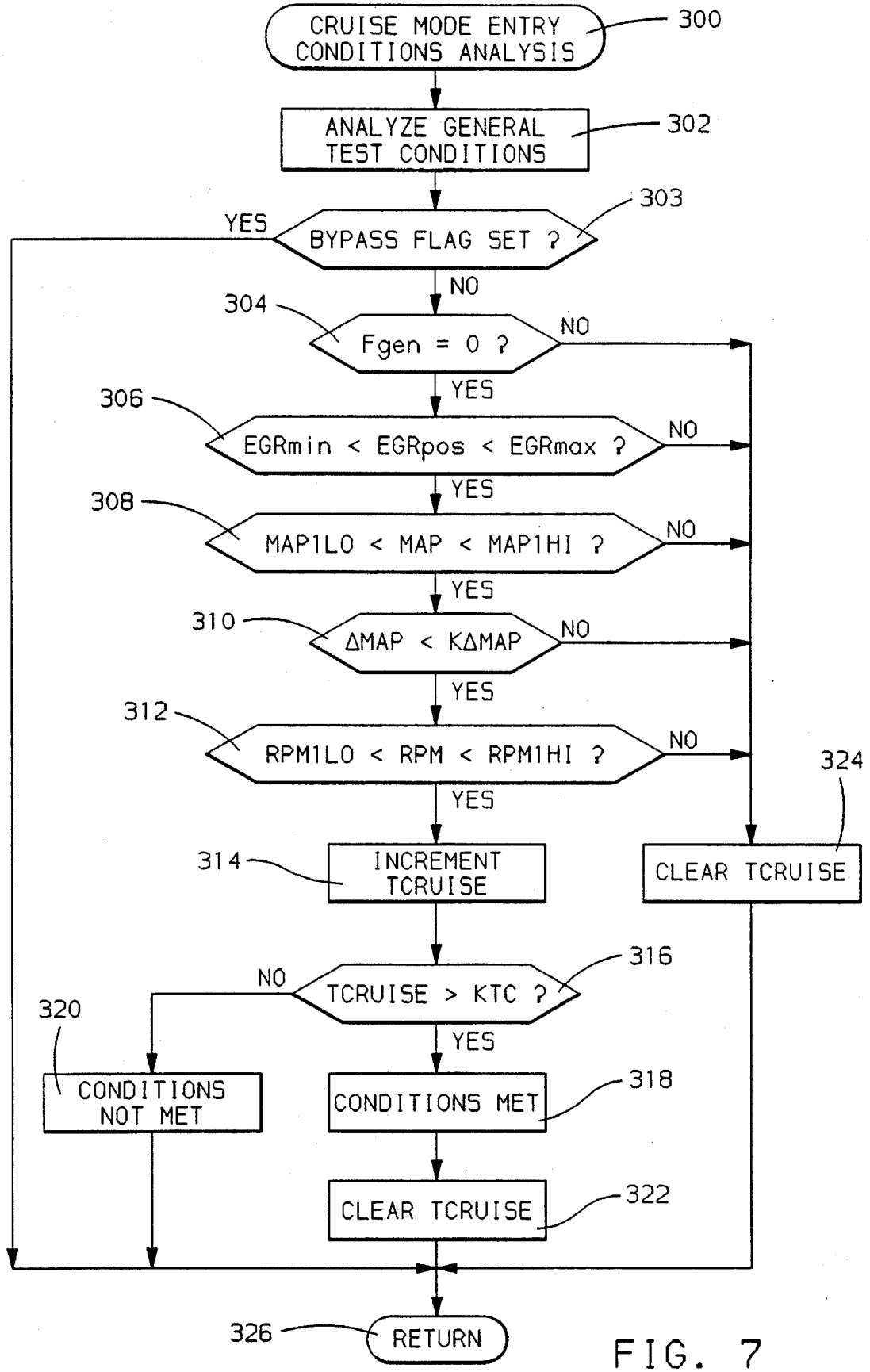

The analysis of cruise mode test entry conditions is provided in the routine of FIG. 7, which is called at the step 100 of FIG. 3, as described, and when called is entered at a step 300. The preconditions for the cruise mode diagnostic test of the present embodiment were established, such as through a conventional calibration process, as those vehicle operating conditions supporting a reliable diagnosis of the EGR system of the vehicle powertrain. Such preconditions may vary according to the system to which the diagnostic of the present invention is applied.

To analyze such preconditions in the present embodiment, the routine of FIG. 7 proceeds to a step 302 to analyze the general test conditions as provided in the described routine of FIG. 4. Next, the routine advances to a step 303 to determine if a bypass flag, set elsewhere in the routines of this embodiment as will be described, is set. If the bypass flag is set, the test preconditions illustrated through the steps 304–316 are not to be executed, and the routine moves directly to the step 326, to return to the routine from which the routine of FIG. 7 was called.

Alternatively, the analysis of the cruise mode test preconditions is continued by moving from the step 303 to a step 304, to determine if the flag FGEN is clear indicating that the general test conditions analyzed in the routine of FIG. 4 are all present. If FGEN is clear, the routine proceeds to a step 306 to determine if the position of the EGR valve is within the predetermined range conducive for the cruise mode test of this embodiment. This range is defined by lower and upper bounds EGRmin and EGRmax, with EGRmin set to approximately 30 percent of the overall EGR valve range and EGRmax set to about 60 percent of the overall EGR valve range.

If EGRpos is within the range at the step 306 then the routine proceeds to a step 308 to determine if manifold pressure MAP is within a range defined by MAP1LO set to approximately 40 kPa and MAP1HI set to approximately 65 kPa. If MAP is within this range at the step 308, the routine proceeds to a step 310 to determine if change in manifold absolute pressure ΔMAP, as determined over a predetermined short time interval, is less than KΔMAP which is set to approximately 0.5 kPa in this embodiment, to determine whether MAP is efficiently stable to allow the cruise mode diagnostic to reliably be carried out. If ΔMAP indicates a stable manifold absolute pressure at the step 310 in the described manner, the routine proceeds to a step 312 to determine if engine speed RPM is within a range defined by RPM1LO, set to approximately 1200 RPM and RPM1HI set to approximately 1700 RPM. If engine speed is within this range, which is predetermined to be an engine speed range in which the present diagnostic may be reliably carried out, the routine proceeds to a step 314 to increment a cruise timer TCRUISE to record the number of iterations of routine of FIG. 7 in which cruise mode entry conditions were present. Only after a sufficient number of consecutive iterations of routine of FIG. 7 in which the cruise mode entry positions are present will the cruise mode test be carried out in this embodiment. After incrementing TCRUISE at the step 314, the routine proceeds to a step 316 to determine if TCRUISE exceeds a value KTC. The value KTC is set to 0.5 when the routine of FIG. 7 is called from the routine of FIG. 8*a* at step 364 thereof, or is set to one when the routine of FIG. 7 is called from the routine of FIG. 3 at step 100.

If TCRUISE exceeds KTC at the step 316, the routine proceeds to a step 318 to indicate that the conditions for the cruise mode test have been met and then proceeds to a step 322 to clear TCRUISE for the next attempted entry into the cruise mode. The routine then proceeds to a step 326 at which it is directed to return to the routine from which it was called, such as step 100 of the FIG. 3 or step 364 of FIG. 8*a*. Alternatively at the step 316, if TCRUISE does not exceed KTC then the conditions have not persisted for a sufficient amount of time to allow the cruise mode test to continue, and the routine proceeds to a step 320 to indicate the conditions for the cruise mode test are not met. The routine then advances to the described step 326.

If the decision blocks of 304, 306, 308, 310 or 312 indicate a negative decision such that some of the cruise mode entry conditions have not been met, the routine of FIG. 7 proceeds to a step 324 to clear TCRUISE to reset the timer for the next attempted entry into the cruise mode and then proceeds to a step 326 to return to the routine from which the routine of FIG. 7 was called.

Figure 8A:
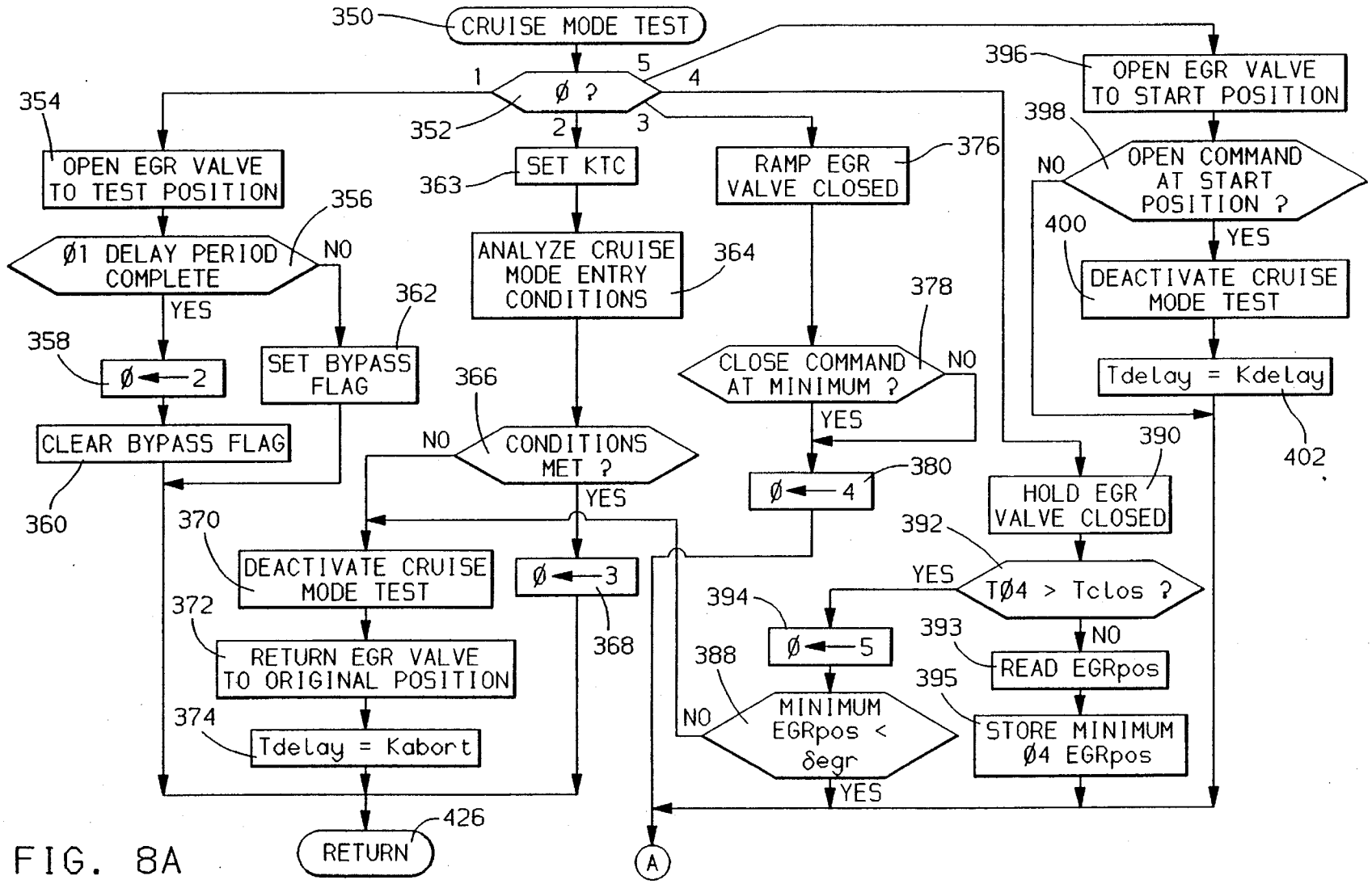
Figure 8B:
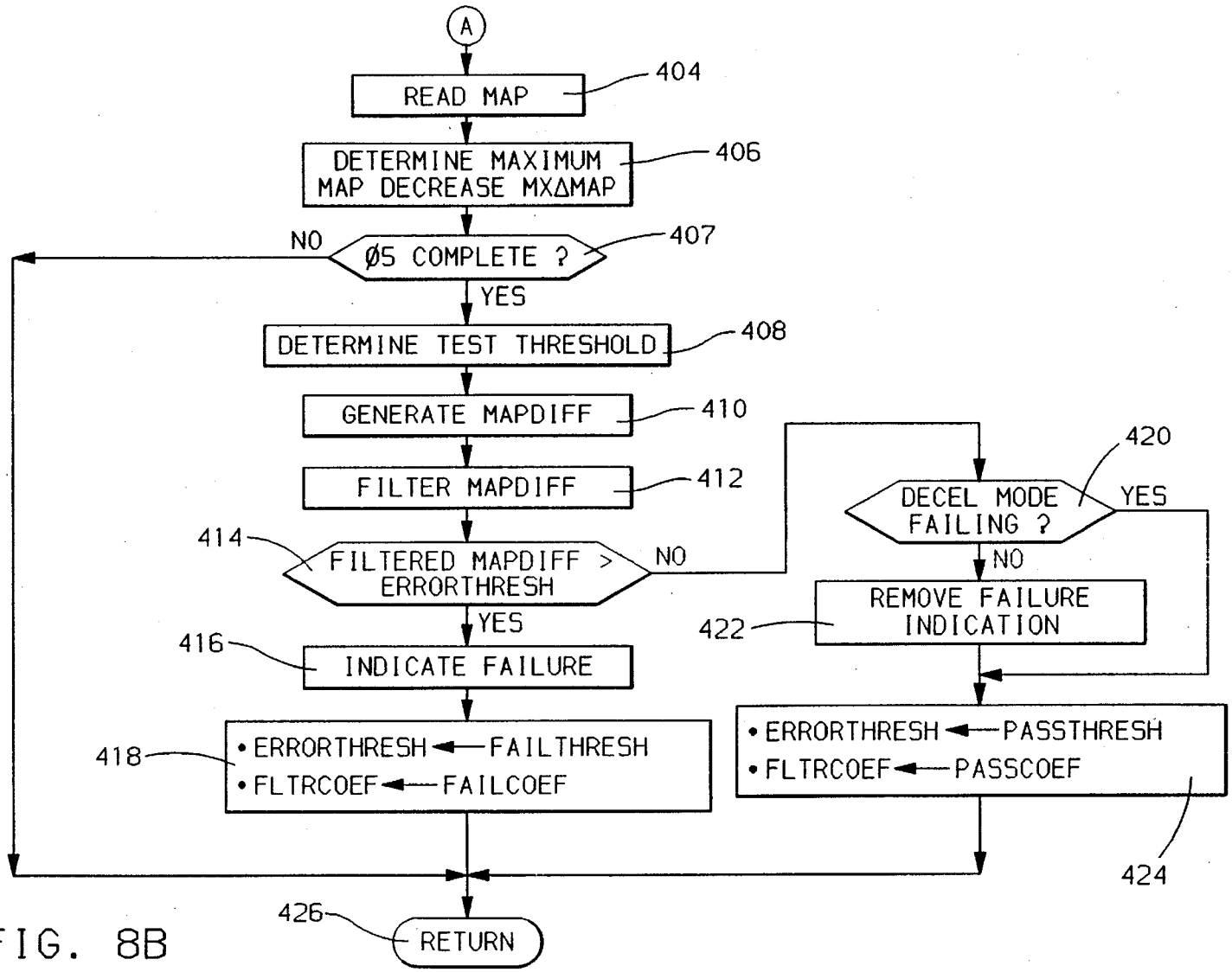

The cruise mode test may be carried out through the steps of FIGS. 8*a* and 8*b* of this embodiment starting at a step 350, such as when called at step 106 or step 80 of the routine of FIG. 3, as described. The cruise mode routine moves to a step 352 to determine the active phase $\phi$ of the cruise mode test. If the active phase is phase one the routine proceeds to a step 354 to open the EGR valve to a test position. The test position may be predetermined as a function of engine speed RPM and barometric pressure BARO so as to account for the sensitivity of flow restriction and the relationship of change in MAP to change in barometric pressure on engine speed. The test position must be less than equal to the EGR valve position at the start of the test, and is used to analyze a series of conditions necessary to be present for the cruise mode test to take place.

After commanding the EGR valve to open to the test position at the step 354, the routine proceeds to a step 356 to determine if the phase one delay period is complete. The phase one delay period is set to approximately 500–1000 milliseconds in this embodiment to allow the valve position to stabilize for analysis of the conditions precedent to the cruise mode test. If the phase one delay period is complete as determined at the step 356, the phase is set to two at a step 358 to indicate the completion of phase one and the initiation of phase two of the current cruise mode test, after which the routine proceeds to a step 360 to clear a bypass flag used to bypass the test conditions analyzed via the routine of FIG. 7, as described.

Returning to the step 356, if the phase one delay period is not complete, the routine proceeds to a step 362 to set the bypass flag so as to avoid analysis of certain predetermined test conditions of the routine of FIG. 4 during phase 1 of the cruise mode diagnostic, in which no analysis of such conditions is required. After clearing the bypass flag at the step 360 or setting it at the step 362, the routine of FIGS. 8*a* and 8*b* proceeds to return to the routine from which it was called via the step 426.

Returning to the step 352, if the phase $\phi$ is set to two, the routine proceeds to a step 363 to set the value KTC to a value representing about 500 milliseconds, for use in the described entry condition analysis routine of FIG. 7. The routine then moves to a step 364 to analyze cruise mode entry conditions, such as by executing the routine of FIG. 7, as described. The routine then proceeds to step 366 to determine if the cruise mode entry conditions were met. If so, the phase two is complete and the phase $\phi$ is set to three at a step 368. If the cruise mode entry conditions are not met as determined at the step 366, the routine proceeds to a step 370 to de-activate the cruise mode test, such as by stopping execution of the test functions. The cruise mode entry conditions are required in this embodiment to persist throughout the cruise mode test.

After de-activating the cruise mode test at the step 370, the routine proceeds to a step 372 to return the EGR valve to the original position it was at prior to the beginning of the current cruise mode test. The routine then proceeds to a step 374 to set the time delay value Tdelay to the value KABORT, to allow approximately 500 milliseconds of time delay before the next diagnostic test is permitted to occur. Next, or after the described step 368, the routine proceeds to the described step 426.

Returning to the step 352, if the phase $\phi$ is set to three, the routine proceeds to a step 376 to ramp the EGR valve from the test position to the closed position to carry out the cruise mode test. The ramp rate or the time rate which the EGR valve is moved from the test position into the closed position is substantially a constant rate over the duration of time in which phase three is active, which is approximately 500 milliseconds in this embodiment. After initiating or continuing the ramping of the EGR valve toward the closed position at the predetermined ramp rate at step 376, the routine proceeds to a step 378 to determine if the EGR valve closing command is at a minimum value indicating that the valve has been commanded closed. If the closing command is at a minimum at the step 378, the phase three of the cruise mode diagnostic is complete and the routine proceeds to a step 380 to set the phase value to four. Next, or if the close command is not at a minimum at the step 378, the routine moves to a step 404, to be described.

Returning to the step 352, if the phase of the cruise mode test is set to four, the routine proceeds to a step 390 to hold the EGR valve at its closed position for the duration of phase four of the test, and then proceeds to a step 392 to compare the time in phase four to a threshold time value Tclos, set to about 1000 milliseconds in this embodiment. If the time in phase four exceeds Tclos, then phase four is complete and the routine proceeds to a step 394 to set the phase value to five. Next, the routine moves to a step 388 to compare a minimum phase four EGR position stored at the step 395, to be described, to a calibrated minimum threshold $\delta$egr, set to about one percent of the overall EGR range of motion. If the minimum position is less than $\delta$egr, the actual EGR valve position substantially corresponds to the commanded EGR position for phase four of the present test mode, such that the EGR valve is in position for a continuation of the cruise mode diagnostic, which requires a substantially closed EGR valve. In such a case, the routine moves from the step 388 to a step 404, to be described. If the valve is not substantially closed, the routine moves from the step 388 to the described steps 370–374, to carry out a deactivation of the present cruise mode diagnostic, to return the EGR valve to its original position, and to set Tdelay to the value Kabort, after which the routine moves to a step 426, as described.

Returning to the step 392, if the time in phase four does not exceed Tclos, the routine moves to steps 393 and 395 to search for and record a minimum EGR valve position over the course of operation of phase four. Specifically, EGRpos is read at the step 393, and then a minimum EGRpos magnitude during the present phase four is determined and stored in PCM 14 (FIG. 1) memory at the step 395. The minimum value is used to verify the actual EGR valve position substantially corresponds to the commanded position, as described at the step 388. After determining and storing the minimum EGR valve position, the routine moves from step 395 to the step 404.

Returning to the step 352, if the phase value is set to five then the phase five of the cruise mode test is active and the routine proceeds to a step 396 to open the EGR valve at a predetermined substantially constant ramp rate to its start position. The ramp rate is determined as the total amount of required motion divided by the time period, such as about 500 milliseconds in this embodiment, such as was previously described in this embodiment. After beginning the opening of the EGR valve at the appropriate ramp rate at the step rate 396, the routine proceeds to a step 398 to determine if the opening command used to open the EGR valve is at the start position, indicating that the EGR position command has attempted to restore the EGR valve to its initial position.

If the open command is at its start position at the step 398, the routine proceeds to a step 400 to deactivate the cruise mode test which is now complete, and then proceeds to a step 402 to set the time delay value to Kdelay indicating that a completed test has occurred and that a full delay period of approximately one second should occur before the next cruise mode test or the next deceleration mode test occurs.

Next, or if the open command was not yet at the start position at the step 398, the routine proceeds to a step 404 to read MAP, for analysis of the impact of EGR valve position changes on MAP in accord with this diagnostic. Next, the routine moves to a step 406 to determine a maximum MAP decrease value MXΔMAP as the maximum difference between a predetermined reference MAP value and MAP values measured at the step 404. The value MXΔMAP will ultimately represent the largest difference between the predetermined threshold and the MAP values measured at the step 404 over a predetermined time period, such as over the cruise mode test period of this embodiment.

After determining MXΔMAP at the step 406, the routine proceeds to a step 407 to determine if the current cruise mode test is complete, as may b indicated by phase five of the current test being complete. If the phase five is complete, the EGR valve have completed its path or profile of controlled motion over which path the MAP has been monitored for a maximum decrease as described, and the routine may move to the step 408–424 to analyze the maximum MAP Decrease. Such steps are not executed if the cruise mode test is not complete as determined at the step 407, by moving directly to the described step 426.

Specifically, if the cruise mode test is determined to be complete at the step 407, the routine moves to a step 408 to determine a test threshold value as a predetermined function of an engine speed reported during steady state conditions at the start of the engine operation and as a function of current barometric pressure BARO, as was described for the test threshold value of step 266 of the deceleration mode test of FIG. 6.

After determining the test threshold value at the step 408, the routine proceeds to a step 410 to determine a map difference value MAPDIFF as the difference between MXΔMAP and the test threshold value. The routine then proceeds to a step 412 to filter the MAPDIFF value in accord with a conventional lag filter process to generate FMAPDIFF as follows $$FMAPDIFF=FMAPDIFF-(FMAPDIFF-MAPDIFF)*FLTRCOEF$$

in which FLTRCOEF, the lag filter coefficient, is determined through the exponentially weighted moving average process, as is generally understood in the art. The filter coefficient FLTRCOEF varies in this embodiment, such as in the manner described in the routine of FIG. 6 wherein the coefficient is set to 0.1 unless a failure is determined to be present in the EGR system at which time the filter coefficient is adjusted to 0.3.

After filtering MAPDIFF using the lag filter process including a dynamic filter coefficient, the routine proceeds to a step 414 to compare FMAPDIFF value to an error threshold value ERRORTHRESH, wherein ERRORTHRESH is set to one kPa for a non-failing EGR system and is set to 0.5 kPa for a failing EGR system, as was described for the deceleration mode test of FIG. 6. If the filtered MAPDIFF value exceeds the error threshold value at the step 414, the routine proceeds to a step 416 to indicate the failure, such as in the manner described in the routine of FIG. 6 at the step 280. The routine then proceeds to a step 418 to adjust the error threshold value ERRORTHRESH to the failing threshold value FAILTHRESH of approximately 0.5 kPa and to adjust the filter coefficient value FLTRCOEF to the failing filter coefficient value FAILCOEF of approximately 0.3, as described. The routine then proceeds to the described step 426.

Returning to the step 414, if FMAPDIFF does not exceed ERRORTHRESH then the EGR system is not diagnosed to be faulty during the current cruise mode test and the routine proceeds to a step 420 to determine if the most recent deceleration mode diagnosed a failing EGR system. If no such failure is present, such that neither the current cruise mode test nor the most recent deceleration mode test diagnosed EGR system faults, the routine of FIGS. 8*a* and 8*b* proceeds from the step 420 to a step 422 to remove any failure indication that may have been provided at the step 416, and then proceeds to a step 424 to set ERRORTHRESH to PASSTHRESH of about one kPa, and to set FLTRCOEF to PASSCOEF of about 0.1 as described at the step 278 of the routine of FIG. 6. The routine then proceeds to the described step 426.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. A method for detecting restriction in an internal combustion engine exhaust gas flow path through which exhaust gas is recirculated to an engine intake manifold in accord with a degree of opening of a controlled valve in the flow path, comprising the steps of:

providing a predetermined schedule of valve opening positions including a plurality of intermediate valve positions between a valve closed position and a valve fully open position;

determining when the engine is operating within a predetermined one of a predetermined cruise state characterized by a substantially stable engine intake air valve and a predetermined deceleration state characterized by a substantially closed engine intake air valve;

establishing a test period while the engine is determined to be operating within the predetermined one;

analyzing a relationship between valve position and engine intake manifold pressure during the established test period, comprising the steps of (a) moving the valve through the predetermined schedule of valve opening positions, (b) periodically sampling intake manifold pressure while the valve is moving through the predetermined schedule, (c) determining a maximum change in sampled intake manifold pressure between samples, (d) comparing a predetermined function of the determined maximum to a predetermined pressure change threshold, and (e) diagnosing a restriction in the flow path when the predetermined function exceeds the pressure change threshold.

2. The method of claim 1, further comprising the step of:

adjusting the magnitude of the predetermined pressure change threshold by setting the threshold to a predetermined adjustment value when the restriction is diagnosed.

3. The method of claim 1, wherein the predetermined function is a lag filter function having a predetermined lag filter coefficient.

4. The method of claim 3, wherein the predetermined lag filter coefficient is determined through the exponentially weighted moving average process.

5. The method of claim 3, further comprising the steps of:

adjusting the predetermined lag filter coefficient by setting the coefficient to a predetermined adjustment coefficient when the restriction is diagnosed.

6. A method for diagnosing restriction in an internal combustion engine exhaust gas recirculation EGR system having a controlled EGR valve for metering exhaust gas flow to an engine intake manifold, comprising the steps of:

sensing present values of a predetermined set of operating parameters;

characterizing a stable operating condition while the sensed present values are determined to be within corresponding predetermined parameter ranges;

providing an EGR valve motion trajectory including a plurality of EGR valve positions between a fully closed EGR valve position and a fully open EGR valve position;

moving the EGR valve through the motion trajectory while the operating conditions are characterized as stable;

periodically sampling air pressure in the engine intake manifold while the EGR valve is moving through the motion trajectory;

determining change in air pressure between samples;

establishing a maximum change in air pressure over a predetermined test period;

comparing a predetermined function of the maximum change to a predetermined pressure change threshold value; and diagnosing a restriction in the EGR system when the predetermined function exceeds the predetermined pressure change threshold value.

7. The method of claim 6, further comprising the step of decreasing the predetermined pressure change threshold value by a predetermined decrease amount when a restriction is diagnosed.

8. The method of claim 6, wherein the predetermined function is a lag filter function including a predetermined lag filter coefficient, further comprising the step of:

decreasing the filter coefficient by a predetermined amount upon diagnosing a restriction in the EGR system.

9. The method of claim 6, wherein the internal combustion engine receives fresh air across an intake air valve, the method further comprising the steps of:

sensing operation within a predetermined cruise state characterized by the intake air valve being within a predetermined position range over a predetermined time interval; and sensing operation within a predetermined deceleration state characterized by the intake air valve being substantially closed to fresh air flow;

and wherein the characterizing step characterizes a stable operating condition while operation with the predetermined cruise state is sensed and characterizes a stable operating condition while operation within the predetermined deceleration state is sensed.

* * * * *